US005537826A

United States Patent [19]

Gschneidner, Jr. et al.

[11] Patent Number: 5,537,826

[45] Date of Patent: Jul. 23, 1996

[54] ERBIUM-BASED MAGNETIC REFRIGERANT (REGENERATOR) FOR PASSIVE CRYOCOOLER

[75] Inventors: Karl A. Gschneidner, Jr.; Vitalij K. Pecharsky, both of Ames, Iowa

[73] Assignee: Iowa State University Research Foundation, Inc., Ames, Iowa

[21] Appl. No.: 266,090

[22] Filed: Jun. 27, 1994

[51] Int. Cl.[6] ..... F25B 9/00

[52] U.S. Cl. ..... 62/6; 148/301; 420/416

[58] Field of Search ..... 148/301, 302; 420/416; 62/3.1, 6; 165/4, 10

[56] References Cited

U.S. PATENT DOCUMENTS

| | | | |
|---|---|---|---|
| 4,829,770 | 5/1989 | Hashimoto et al. | 62/3.1 |
| 5,186,765 | 2/1993 | Arai et al. | 148/301 |
| 5,269,854 | 12/1993 | Takahashi et al. | 148/301 |

OTHER PUBLICATIONS

The Heat Capacities of Seven Rare–Earth Ethylsulphates at Low Temperatures; J. Phys. Chem. Solids, vol. 9, (1959), pp. 285–295; Meyer, et al.

Low Temperature Heat Capacities of Laves Phase Lanthanide—Aluminum Compounds; J. Phys. Chem. Solids, vol. 32 (1971), pp. 1853–1866; Deenadas, et al.

The Crystal Structure and Magnetic Properties of $R_6Ga(Co,Ni)_2$ and $R_6SnNi_2$ Compounds (R is a Rare–Earth Metal); Jkr. Fiz. Zhur. vol. 29, (1984) pp. 1342–1345; Sichevich, et al.

The Crystal Structure of $R_6GaCo_2$ Compounds (R=Y, Tb, Dy, Ho, Er, Tm, Lu); Dopovidi Akad. Nauk, Ukr. RSR Series A, [2] (1983), pp. 67–70; Gladyshevski, et al.

Heat Capacity in Superconducting and Normal–State $LaS_x$ ($1.333 \leqq x \leqq 1.500$) Compunds, Physical Review B, vol. 25, No. 7, Apr. 1, 1982, pp. 4604–4617; Ikeda, et al.

Superconductivity News, Monthy Technical Edition; Superconductivity Pub., Inc. 1994, Jan. 26, 1994, vol. 6, No. 16, pp. 1–11.

High Efficient Two–Stage GM Refrigerator With Magnetic Material in the Liquid Helium Temperature Region; Adv. in Cryogenic Eng. vol. 35, pp. 1261–1269; Kuriyama, et al. 1990.

Recent Advance in Magnetic Regenerator Material; Cryogenics, vol. 30, (Sep. supplement) 1990, pp. 192–198; Hashimoto et al.

New Magnetic Material $R_3T$ System with Extremely Large Heat Capacities Used as Heat Regenerators; Adv. in Cryogenic Eng. vol. 35, (1990), pp. 1175–1182; Sahashi, et al.

Extremely Large Heat Capacities Between 4 and 10K; Cryogenics, May, 1975, vol. 15, pp. 261–264; Bushow, et al.

Specific Heat in Some Gadolinium Compounds. I. Experimental; The American Physical Society, vol. 43, No. 16, Jun. 1, 1991, pp. 137–144; Bouvier, et al.

Specific Heat of a Regenerator Material $Er_3Ni$; J. Appl. Phys., vol. 33, No. 2 (1994), pp. 1023–1026; Takahashi, et al.

The Influence of Cyrstalline Electric Field on the Low Temperature Properties of $CeCd_{11}$; J. Magnetism and Magnetic Mat. 75. (1988), pp. 355–360; Tang, et al.

Low–Temperature Heat Capacity of $LaPt_2$ and $CePt_2$ and the Magnetic Susceptibility of $CePt_2$; Physical Review B. vol. 5, No. 5, Mar. 1, 1972, pp. 1878–1885; Joseph, et al.

*Primary Examiner*—John Sheehan
*Attorney, Agent, or Firm*—Edward J. Timmer

[57] ABSTRACT

A two stage Gifford-McMahon cryocooler having a low temperature stage for reaching approximately 10K, wherein the low temperature stage includes a passive magnetic heat regenerator selected from the group consisting of $Er_6Ni_2Sn$, $Er_6Ni_2Pb$, $Er_6Ni_2(Sn_{0.75}Ga_{0.25})$, and $Er_9Ni_3Sn$ comprising a mixture of $Er_3Ni$ and $Er_6Ni_2Sn$ in the microstructure.

11 Claims, 8 Drawing Sheets

NOTE: THE MATERIALS "$Er_6Ni_2Pb$", "$Er_9Ni_2Sn$" AND $Er_6Ni_2(Sn_{0.75}Ga_{0.25})$ ARE AFTER ARC-MELTING.

NOTE: THE MATERIALS "$Er_6Ni_2Pb$", "$Er_9Ni_2Sn$" AND $Er_6Ni_2(Sn_{0.75}Ga_{0.25})$ ARE AFTER ARC-MELTING.

ERBIUM-BASED MAGNETIC REFRIGERANT (REGENERATOR) FOR PASSIVE CRYOCOOLER

CONTRACTUAL ORIGIN OF INVENTION

The United States Government has rights in this invention pursuant to Contract No. W-7405-ENG-82 between the U.S. Department of Energy and Iowa State University, Ames, Iowa, which contract grants to the Iowa State University Research Foundation, Inc. the right to apply for this patent.

FIELD OF THE INVENTION

The present invention relates to magnetic refrigerants (heat regenerators) for a two-stage Gifford-McMahon cryocooler or refrigerator and, more particularly, to Er-based alloy magnetic refrigerants (heat regenerators) and cryocoolers including same.

BACKGROUND OF THE INVENTION

Two stage Gifford-McMahon cycle cryocoolers or refrigerators (hereafter GM cryocoolers or refrigerators) are devices that can be used to reach extremely low temperatures, such as approximately 4K, without a liquid refrigerant. A two stage GM cryocooler or refrigerator is discussed in U.S. Pat. No. 5,186,765.

In one application, two stage GM cryocoolers or refrigerators are used to cool the liquid helium (He) in magnetic resonance imaging (MRI) equipment in use as a medical diagnostic tool. For example, a GM cryocooler or refrigerator is used to cool the liquid He in MRI units so that the vapor pressure is lowered to reduce He losses and the need to frequently replace the liquid He in the unit. For example, without a GM cryocooler or refrigerator, the liquid He in an MRI unit typically needs to be replaced once every month. However, with a GM cryocooler to reduce He losses, the liquid He in the MRI unit needs to be replaced only once every six months, thereby allowing greater use of the MRI unit for medical diagnostic testing and lowering the overall cost of providing such medical diagnostic testing.

The potential use of lanthanide materials, which exhibit low magnetic ordering temperatures (e.g. less than 10K), as cryogenic regenerator materials (refrigerant or cold accumulating materials) was pointed out nearly 20 years ago by Buschow et al. in an article entitled "Extremely Large Heat Capacities between 4 and 10K", *Cryogenics*, vol. 15, (1975), pages 261–264. However, a practical lanthanide regenerator material was not developed and put into use until about 15 years later when use of $Er_3Ni$ as a low temperature stage regenerator material in a two-stage GM cryocooler was proposed by Sahashi et al. in "New Magnetic Material R3T System with Extremely Large Heat Capacities Used as Heat Regenerators", *Adv. Cryogenic Eng.*, vol. 35, (1990), pages 1175–1182 and by Kuriyama et al. in "High Efficient Two-Stage GM Refrigerator with Magnetic Material in Liquid Helium Temperature Region", *Adv. Cryogenic Eng.*, vol. 35, (1990), pages 1261–1269.

These articles proposed the replacement of the prototype lead lower stage regenerator material with $Er_3Ni$ material. Use of lead (Pb) as the prototype lower stage regenerator material permitted cooling to 10K, which was the lower temperature limit for a cryocooler using a lead lower stage regenerator material. Replacement of the lead lower stage regenerator material with $Er_3Ni$ material permitted improved cooling to approximately 4.2K instead of the approximately 10K achievable with the previously used lead lower stage regenerator material with a reasonable refrigeration capacity at the lowest temperature. This improvement in cooling (i.e. to approximately 4.2K that is degrees Kelvin) is attributable to the significantly higher heat capacity of $Er_3Ni$ than lead below 10K (the heat capacity of lead drops to zero at approximately 5K).

Although GM cryocoolers employing $Er_3Ni$ lower temperature stage regenerators have proved effective, there are some cooling applications (such as real time magnetic resonance imaging (MRI units) also referred to recently as magnetic resonance therapy (MRT), superconductors, scientific instruments, spectroscopy, materials characterization, radio astronomy, matrix isolation, etc.) where it would be desirable to employ a lower temperature stage regenerator material having a higher heat capacity than $Er_3Ni$ at about 10–15K and also for other applications (such as IR detectors, liquifaction of helium, MRI units, cryopumping, low noise measuring instruments, materials characterization, superconductors, radio astronomy, etc.) where it would be desirable to employ a lower temperature regenerator material having a higher heat capacity than $Er_3Ni$ below about 5K.

It is an object of the invention to provide a low temperature passive magnetic heat regenerator (also known as magnetic refrigerant or cold accumulator) especially useful for the low temperature stage of a two stage GM cryocooler, as well as GM cryocooler using same, having significantly higher heat capacity than previously used lower temperature stage materials, such as $Er_3Ni$ and Pb, between about 8 and about 19K.

SUMMARY OF THE INVENTION

The present invention provides in one embodiment a two stage Gifford-McMahon cycle cryocooler having a low temperature stage and a high temperature stage, wherein the low temperature stage includes a passive magnetic heat regenerator selected from the group of alloys having the approximate atomic composition of $Er_6Ni_2Sn$, $Er_6Ni_2Pb$, and $Er_6Ni_2(Sn_{1-x}Ga_x)$ where $0<x<1$ (e.g. $Er_6Ni_2(Sn_{0.75}Ga_{0.25})$ which exhibit significantly higher 10 heat capacities on a per unit volume basis (volumetric heat capacities) between about 8K and 19K than $Er_3Ni$ and below 18K than Pb.

The present invention provides in another embodiment a Gifford-McMahon cycle cryocooler having a low temperature stage and a high temperature stage, wherein the low temperature stage includes a passive magnetic heat regenerator comprising a $Er_9Ni_3Sn$ alloy which includes $Er_3Ni$ and $Er_6Ni_2Sn$ in the alloy mixture and which exhibits significantly higher heat capacity on a per unit volume basis between about 8K and 19K than $Er_3Ni$ and below 18K than Pb.

Passive magnetic heat regenerators in accordance with the invention are selected from the group consisting of $Er_6Ni_2Sn$, $Er_6Ni_2Pb$, $Er_6Ni_2(Sn_{1-x}Ga_x)$ where $0<x<1$, and $Er_9Ni_3Sn$ having $Er_3Ni/Er_6Ni_2Sn$ phases.

DETAILED DESCRIPTION OF THE INVENTION

Figure 14:
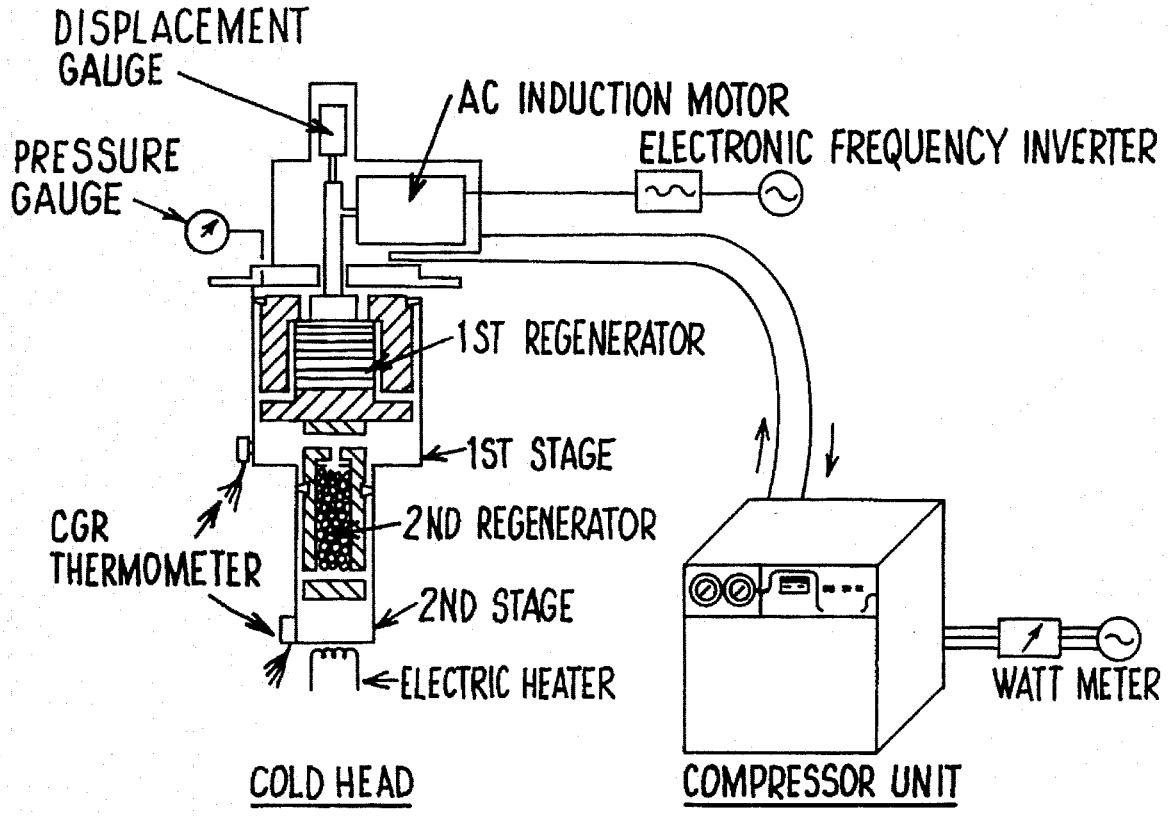
FIG. 14 PRIOR ART
FIG. 14 is a schematic diagram of a two stage GM cryocooler of the type set forth in the Kuriyama et al. article disclosed herebelow wherein the cryocooler includes first and second heat regenerators.

A two stage Gifford-McMahon cryocooler or refrigerator has been used to reach extremely low temperatures, such as approximately 4K, without a liquid refrigerant. A two stage GM cryocooler or refrigerator is discussed in U.S. Pat. No. 5 186 765 and the Kuriyama et al. article "High Efficient Two-Stage GM Refrigerator With Magnetic Material In The Liquid Helium Temperature Region", *Adv. Cryogenic Eng.*, vol. 35, (1990) pages 1261–1289, the teachings of which are incorporated herein with respect to construction of the two stage GM cryocooler. FIG. 14 illustrates schematically a two stage GM cryocooler of this latter Kuriyama et al. article. The two stage GM cryocooler comprises a first stage having a first heat regenerator typically comprising copper mesh and a second low temperature stage having a second heat regenerator in the past comprising lead (Pb) or, more recently, $Er_3Ni$ particulates. The present invention provides an improved second heat regenerator for the second or lower temperature stage of the GM cryocooler wherein the regenerator material has a significantly higher volumetric heat capacity than Pb below 18K and $Er_3Ni$ between 8K to 19K.

Three binary "reference" alloys ($Pr_3Ni$, $Nd_3Ni$ and $Er_3Ni$), three inventive ternary alloys (with the nominal compositions $Er_6Ni_2Sn$, $Er_6Ni_2Pb$, and $Er_9Ni_3Sn$) and an inventive quaternary alloy having the composition of $Er_6Ni_2(Sn_{1-x}Ga_x)$ where $0<x<1$ (x greater than zero and less than 1; e.g. a nominal $Er_6Ni_2$ $(Sn_{0.75}Ga_{0.25})$ alloy composition) were each arc-melted in a purified argon atmosphere from stoichiometric mixtures of constituent elements. The praseodymium, neodymium and erbium metals were greater than 99.8 atomic % pure with main impurities being the interstitial non-metallic elements (H, C, N, O and F). The other components were of following certified commercial purity: Ni-4N, Sn-4N, Pb-5N and Ga-4N. The arc melted buttons were turned over 4 to 7 times and re-melted to ensure each alloy's homogeneity. The total weight losses during-arc-melting were less than 0.5% for all samples, such that resulting stoichiometry was assumed to remain unchanged.

X-ray powder diffraction patterns of the as-cast ternary alloy samples of the invention ($Er_6Ni_2Sn$, $Er_6Ni_2Pb$, $Er_6Ni_2(Sn_{0.75}Ga_{0.25})$) revealed that all of them contained significant amounts of a second phase (and possibly third phase) in addition to the main phase having a $Ho_6Co_2Ga$-type crystal structure. As a result, all the samples were annealed at 700° C., for 2 weeks in helium filled quartz tubes. X-ray diffraction patterns taken after the heat treatment showed that the amount of the phase with $Ho_6Co_2Ga$-type structure increased significantly in each alloy sample. However, within the precision limits of x-ray diffraction, longer (up to 6 weeks) and higher temperature (800° C.) annealing did not change the amount of the phases present or crystal structure of the ternary alloys of the invention. In all four alloys of the invention, two phases exist after heat treating and these consist of the main 6:2:1 ternary Er:Ni:X compound (where X is, for example, Pb, Sn, or $Sn_{0.75}Ga_{0.25}$) and the satellite binary phase, $Er_3Ni$ ($Fe_3C$-type structure). The results described above indicate that the actual composition of the $Er_6Ni_2Sn$ and $Er_6Ni_2Pb$ alloys may be somewhat higher in tin and lead, respectively, (e.g. possibly up to 10% higher in Sn or Pb, respectively) or that these phases are formed during a solid state reaction, or both. As a result, the alloy compositions are set forth herein and in the claims as approximate atomic compositions to encompass possible variation of the Sn or Pb thereof to such extent.

The heat capacities of the prepared alloys were measured by using an adiabatic heat-pulse-type calorimeter in the temperature range 1.5–40K as described in *Phys. Rev. B.*, vol. 25, (1982), pp. 4640–4617, the teachings of which are incorporated herein by reference.

Figure 1:
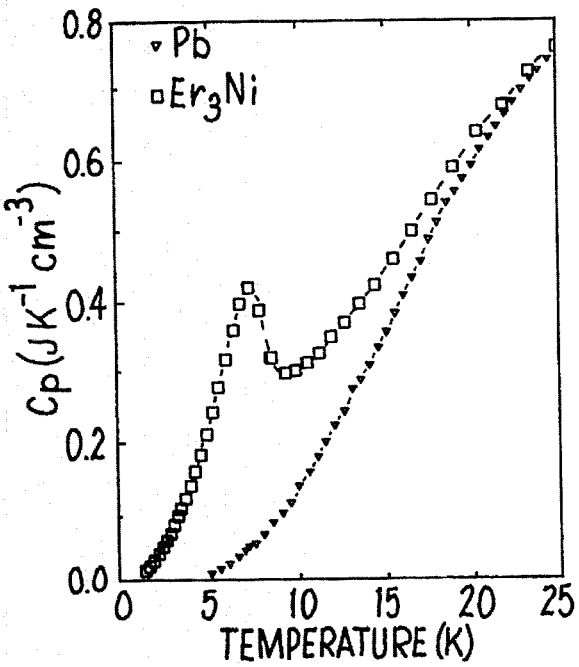
FIG. 1 is a graph of the heat capacity of $Er_3Ni$ and lead (Pb) as a function of temperature from ~1.5 (i.e. approximately 1.5) to 25K.
Figure 2:
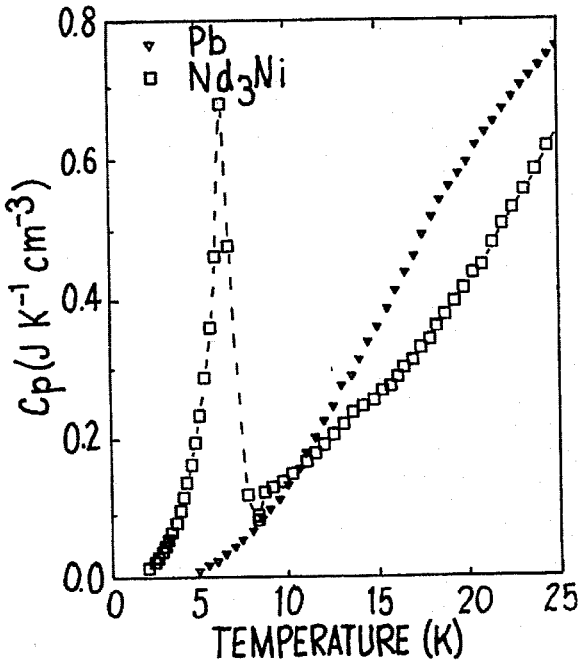
FIG. 2 is a graph of the heat capacity of $Nd_3Ni$ and lead (Pb) as a function of temperature from ~1.5 to 25K.
Figure 3:
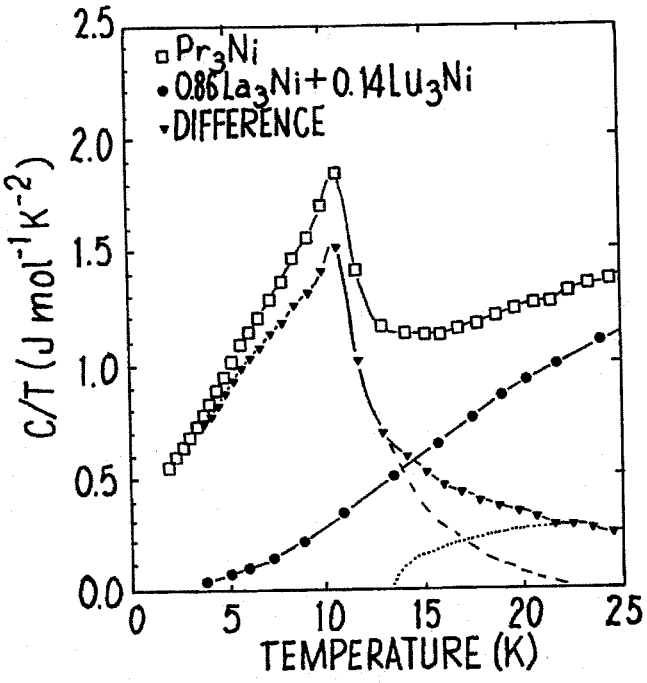
FIG. 3 is a graph of the heat capacity (as C/T) of $Pr_3Ni$, $0.86La_3Ni+0.14Lu_3Ni$, and the difference from ~1.5 to 25K. The area under the difference curve gives the magnetic entropy. The long and short dashed lines shown in FIG. 3 are, respectively, an estimate of the magnetic ordering and crystalline electric field (CEF) contributions to the magnetic entropy between 13K and 21K.

In order to obtain a baseline for heat capacity values, the heat capacity of three $R_3Ni$ compounds, where R=Pr, Nd and Er, was measured. The results for $Er_3Ni$ and $Nd_3Ni$ are shown in FIGS. 1 and 2, respectively relative to Pb. In order to estimate the magnetic entropy associated with magnetic ordering and the Schottky anomaly, the heat capacity of the corresponding La and Lu compounds (e.g. in this case $La_3Ni$ and $Lu_3Ni$) also was measured because these two members of the lanthanide series (the first and last, respectively) do not have any unpaired 4f electrons. The assumption was made, that the lattice and electronic contributions (the latter is generally quite small) vary in a uniform and smooth manner from La to Lu. Thus, by taking the prorata values of the heat capacities of the La and Lu compounds and subtracting it from the corresponding R compound, the difference gives the magnetic heat capacity. This is illustrated for $Pr_3Ni$ in a C/T vs. T plot, FIG. 3. The area under the curves provides the various entropies; in particular the area under the difference curve yields the magnetic entropy. The long and short dashed lines of FIG. 3 show how the magnetic entropy for the magnetic ordering transition and that associated with the CEF contribution, respectively, are estimated when they overlap one another. The estimated magnetic entropy for the. magnetic transitions are 13.5, 15.9 and 19.8 (in J/mol $R_3Ni$ K) for $Pr_3Ni$, $Nd_3Ni$ and $Er_3Ni$, respectively. These values are reasonably close to the value for a ground state doublet (Rln2=17.3J/mol $R_3Ni$ K).

Figure 4:
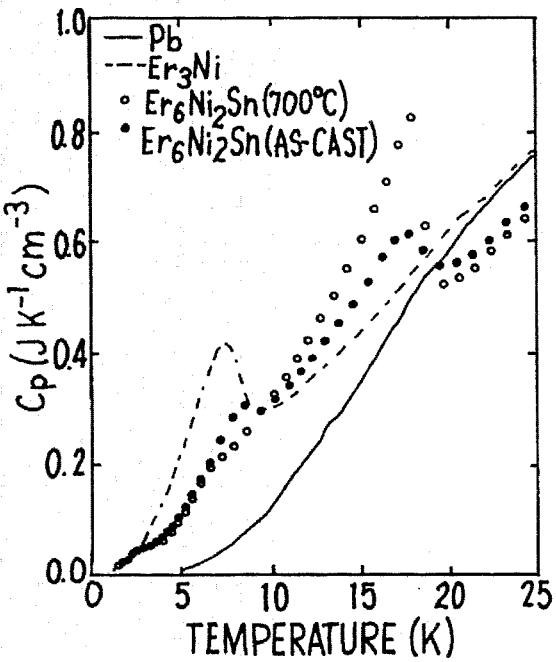
FIG. 4 is a graph of the heat capacity of $Er_6Ni_2Sn$ from 1.5 to 25K in the as-cast and 700° C. annealed conditions. Also shown are the heat capacities of $Er_3Ni$ and Pb.
Figure 5:
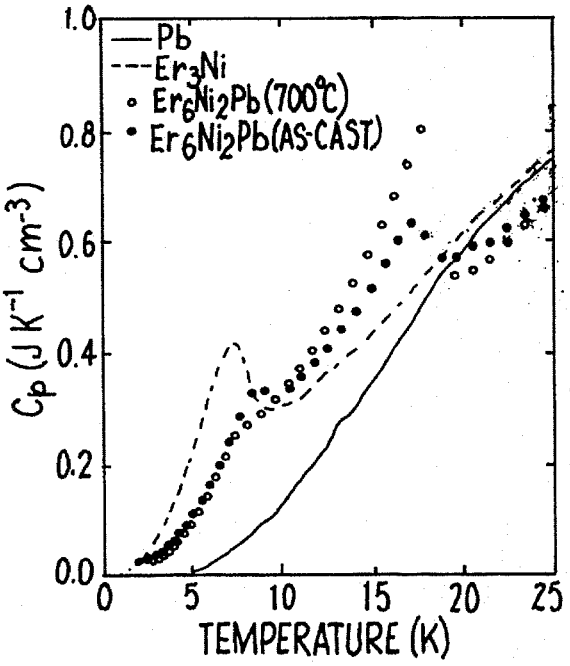
FIG. 5 is a graph of the heat capacity of $Er_6Ni_2Pb$ from 1.5 to 25K in the as-cast and 700° C. annealed conditions. Also shown are the heat capacities of $Er_3Ni$ and Pb.
Figure 6:
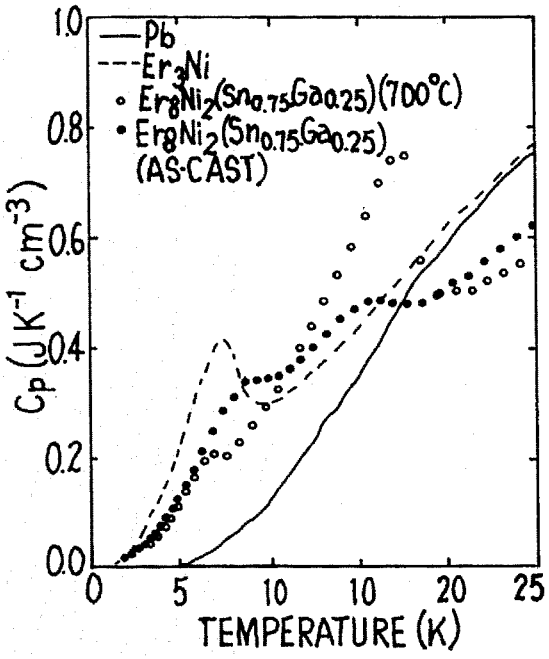
FIG. 6 is a graph of the heat capacity of the quaternary alloy $Er_6Ni_2(Sn_{0.75}Ga_{0.25})$ from 1.5 to 25K in the as-cast and 700° C. annealed conditions. Also shown are the heat capacities of $Er_3Ni$ and Pb.

The measured low temperature heat capacities of the ternary $Er_6Ni_2X$ (X=Pb or Sn) and quaternary $Er_6Ni_2(Sn_{0.75}Ga_{0.25})$ alloys of the invention in both the as-cast and 700° C. annealed states from ~1.5K (i.e. approximately 1.5K) to 25K are compared with those of $Er_3Ni$ and Pb in FIGS. 4 through 7. FIG. 4 shows the results for $Er_6Ni_2Sn$; FIG. 5 for $Er_6Ni_2Pb$; FIG. 6 for $Er_6Ni_2(Sn_{0.75}Ga_{0.25})$ and FIG. 7 for the two phase $Er_9Ni_3Sn$ alloy having 50:50 $Er_6Ni_2Sn/Er_3Ni$ phases (microstructure approximately 50 mole % of each phase). All of the heat capacity curves for the four samples of the invention are quite similar (also see FIGS. 8 and 9).

Figure 8:
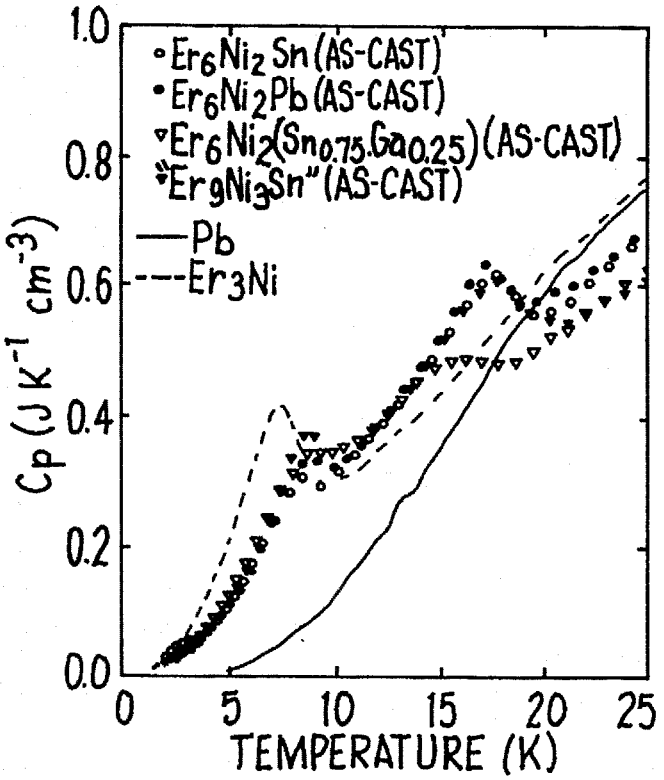
FIG. 8 is a graph of the heat capacities from 1.5 to 25K of the materials of the invention in the as-cast condition. Also shown are the heat capacities of $Er_3Ni$ and Pb.

In the as-cast condition for all samples, a small transition is observed at 2.5±1.0K, a slightly larger one at ~8K and a major peak at 17–18K. The only exception is that the upper most peak in the 50:50 $Er_6Ni_2Sn/Er_3Ni$ material occurs at ~15K instead of 17–18K. These results confirm the x-ray measurements that the as-cast alloys are multiphase alloys comprising $Er_6Ni_2X$ phase and $Er_3Ni$ phase plus a small amount of an unidentified third phase. The middle transformation (~8K) is due to $Er_3Ni$ phase. This is verified by the fact that the heat capacity peak is larger for the 50:50 $Er_6Ni_2Sn/Er_3Ni$ alloy than for the other three alloys of the invention. Also, the fact that the heat capacity peak of pure $Er_3Ni$ at ~7K is shifted upward by about 1K, suggests that some Sn or Pb is substituted for the Er in $Er_3Ni$. It is also noted that between 8 and 19K (except for the 50:50 $Er_6Ni_2Sn/Er_3Ni$ alloy) the ternary and quaternary alloys of the invention have higher heat capacities than $Er_3Ni$ (FIG. 8). In comparison to Pb they have significantly higher heat capacities below 18K (FIG. 8). Above 19K, the heat capacities of the multicomponent alloys of the invention are somewhat lower than both $Er_3Ni$ and Pb.

Figure 7:
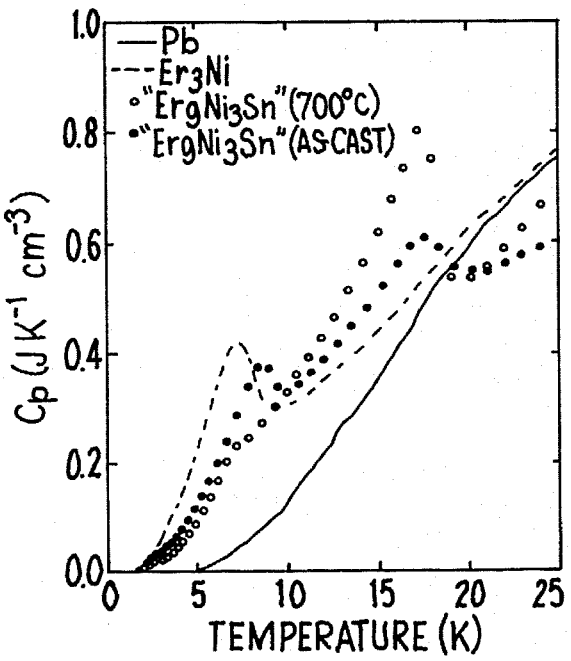
FIG. 7 is a graph of the heat capacity of the 50:50 $Er_6Ni_2Sn/Er_3Ni$ (i.e. $Er_9Ni_3Sn$) material from 1.5 to 25K in the as-cast and 700° C. annealed conditions. Also shown are the heat capacities of $Er_3Ni$ and Ph.
Figure 9:
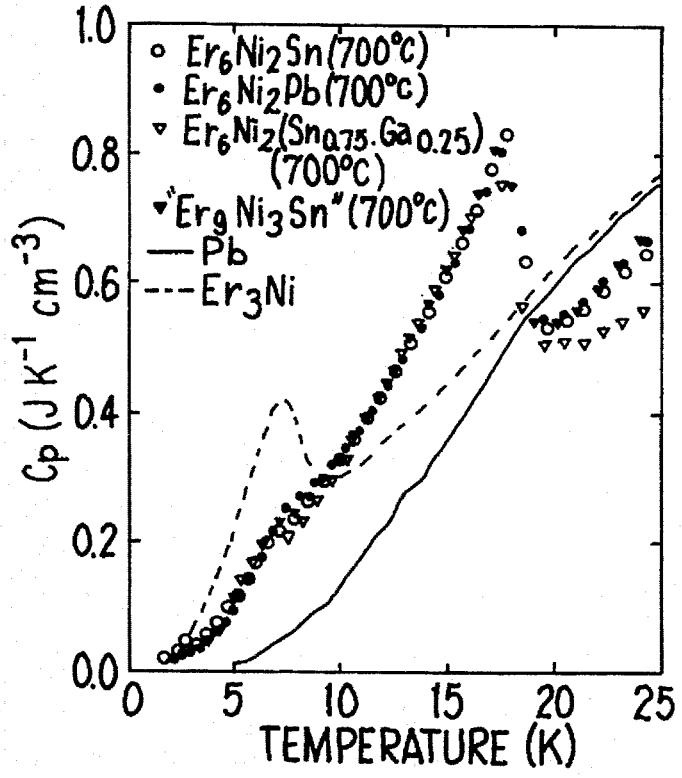
FIG. 9 is a graph of the heat capacities from 1.5 to 25K of the materials of the invention in the 700° C. annealed condition. Also shown are the heat capacities of $Er_3Ni$ and Pb.

After heat treating, the small peak at ~2.5±1K was still present in all of the samples of the invention, where the measurements were made down to 1.5K (see FIGS. 4, 5 and 7). In the case of the $Er_6Ni_2(Sn_{0.75}Ga_{0.25})$ alloy, the lowest measurement was ~3.5K. The $Er_3Ni$ peak (~7K) is much smaller in magnitude and almost disappears. In addition, the peak temperature has decreased from ~8K in the as-cast alloys of the invention to ~7K, which is the ordering peak of pure $Er_3Ni$. These data suggest that the dissolved Sn or Pb in the $Er_3Ni$ phase in the as-cast condition (see above) has precipitated out of solution during the heat treatment at 700° C., leaving an amount of essentially pure $Er_3Ni$ in the sample. The ternary or quaternary alloy heat capacity peak (18K) is greatly enhanced by the heat treatment, indicating that the alloy comprises essentially the pure $Er_6Ni_2Sn$, or $Er_6Ni_2Pb$, or $Er_6Ni_2(Sn_{0.75}Ga_{0.25})$ single phase. This is also evident in the 50:50 $Er_6Ni_2Sn/Er_3Ni$ alloy sample, see FIG. 7, suggesting the $Er_6Ni_2Sn$ composition exists over a solid solution region extending toward $Er_3Ni$. As is seen in FIG. 9, the heat capacities of all four heat treated samples of the invention basically fall on top of one another. However, above 19K, there is some separation of the curves, which is probably due to the different lattice heat capacities. The lattice heat capacity for $Er_6Ni_2Sn$ is intermediate and that for $Er_6Ni(Sn_{0.75}Ga_{0.25})$ is the lowest. This is evident in the as-cast alloys of the invention (FIG. 8). Just as for the as-cast alloys of the invention, the heat treated alloys of the invention have significantly higher heat capacities than that of the $Er_3Ni$ compound from ~9 to 18K, and that of Pb from 1 to 18K. Above 19K, the heat capacities of the materials of the invention fall below those of $Er_3Ni$ and Pb; the heat treated alloys falling more so than the as-cast alloys, which contain some $Er_3Ni$ phase (~25%), compare FIGS. 4 to 7.

Figure 10:
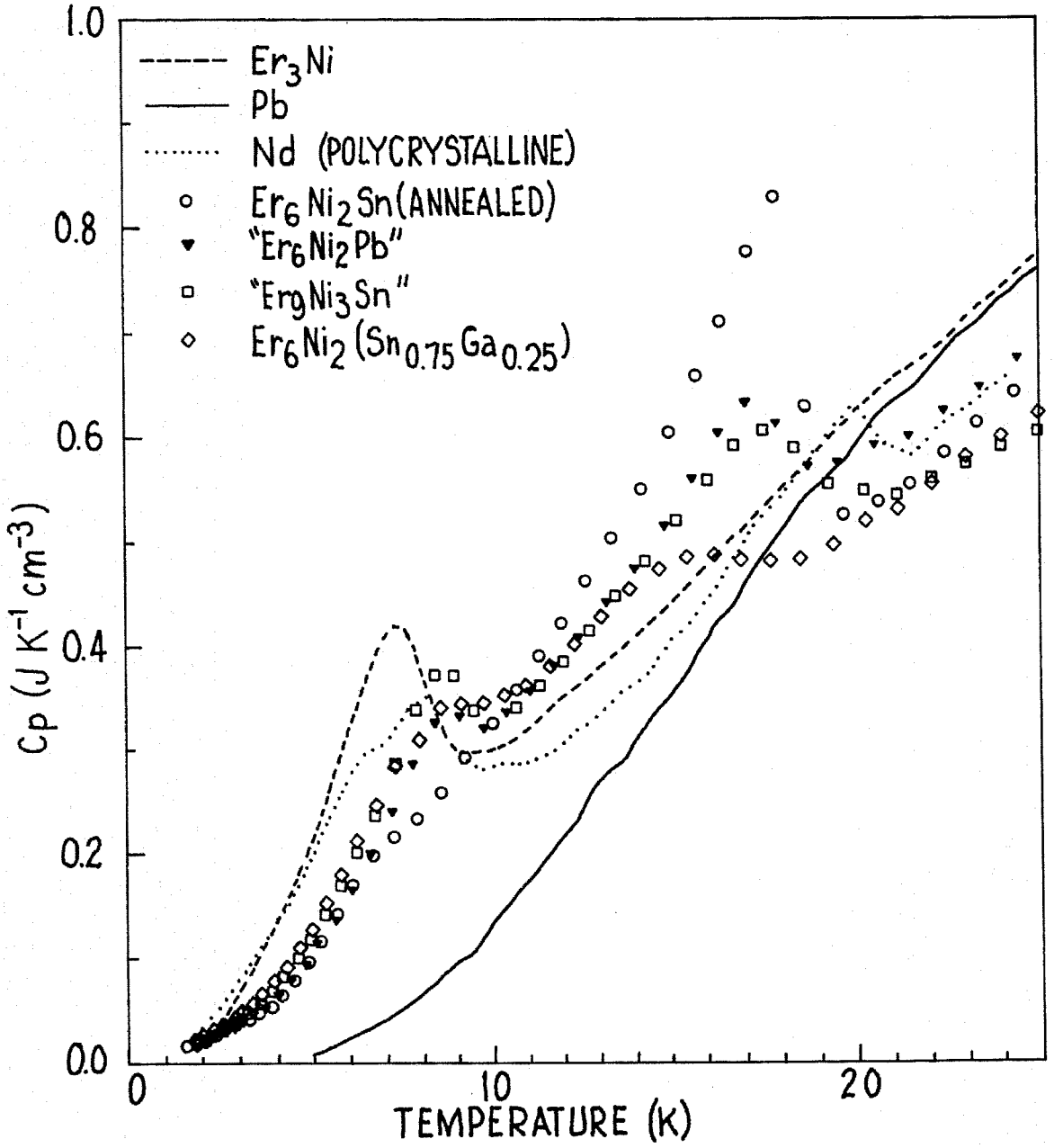
FIG. 10 is a composite graph of heat capacity versus temperature comparing heat regenerator materials of the invention relative to others.

FIG. 10 is a composite graph of heat capacity versus temperature comparing heat regenerator materials of the invention relative to $Er_3Ni$ and Pb and showing the greater heat capacity of the former at certain temperatures as discussed above.

A differential thermal analysis (DTA) study was conducted on heating the $Er_6Ni_2Pb$ samples and revealed that $Er_6Ni_2Pb$ melts incongruently at 934° C. The DTA curve of the as-cast alloys of the invention shows a weak endothermic reaction at 806° C., which is believed to be the melting point of $Er_3Ni$ containing some dissolved Pb in the Er lattice sites. This 806° C. value compares to the 845° C. peritectic melting point reported for $Er_3Ni$. For the heat treated alloys of the invention, the melting temperature for $Er_6Ni_2Pb$ is the same as for the as-cast alloy but the endothermic reaction is much greater in the annealed sample. There is no visible peak at 806° C., but two very small endothermic peaks at 893° and 900° C. The DTA results are consistent with the heat capacity and x-ray diffraction measurements on the as-cast and heat treated $Er_6Ni_2Pb$ alloy.

Figure 11:
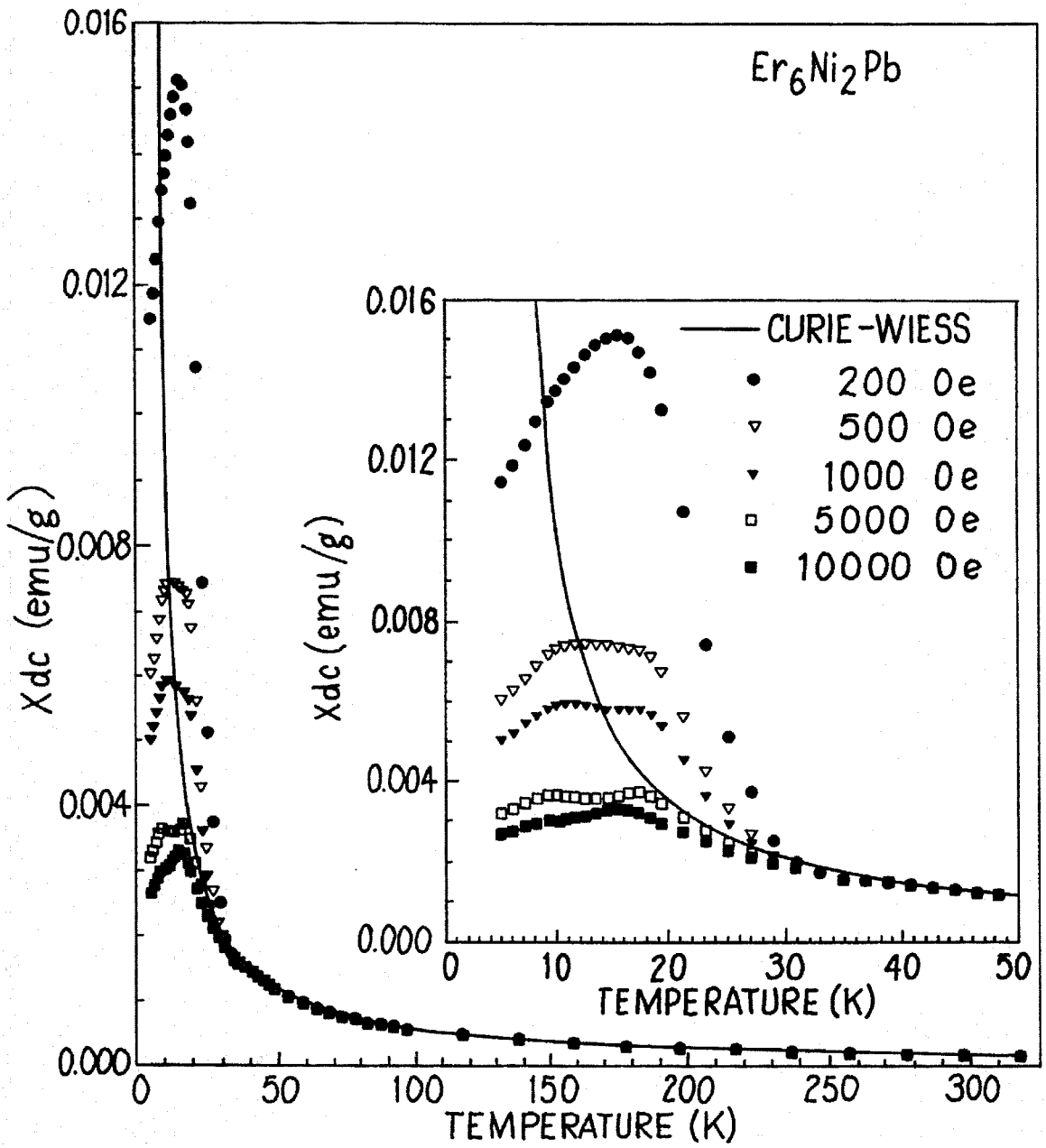
FIGS. 11 and 12 are plots of dc-susceptibility ($\chi_{dc}$) versus temperature for $Er_6Ni_2Pb$ and $Er_6Ni_2(Sn_{0.75}Ga_{0.25})$, respectively.
Figure 12:
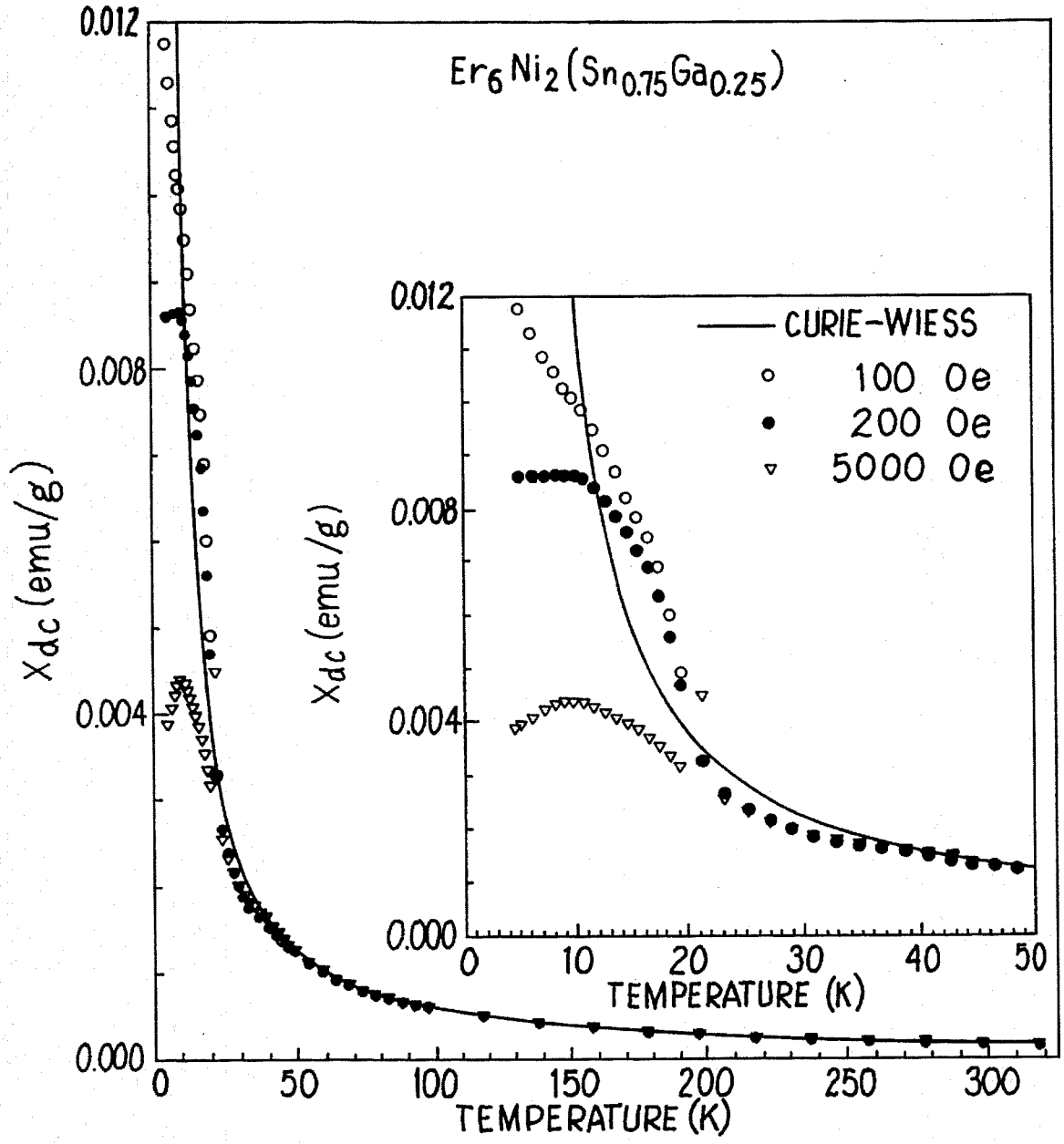
Figure 13:
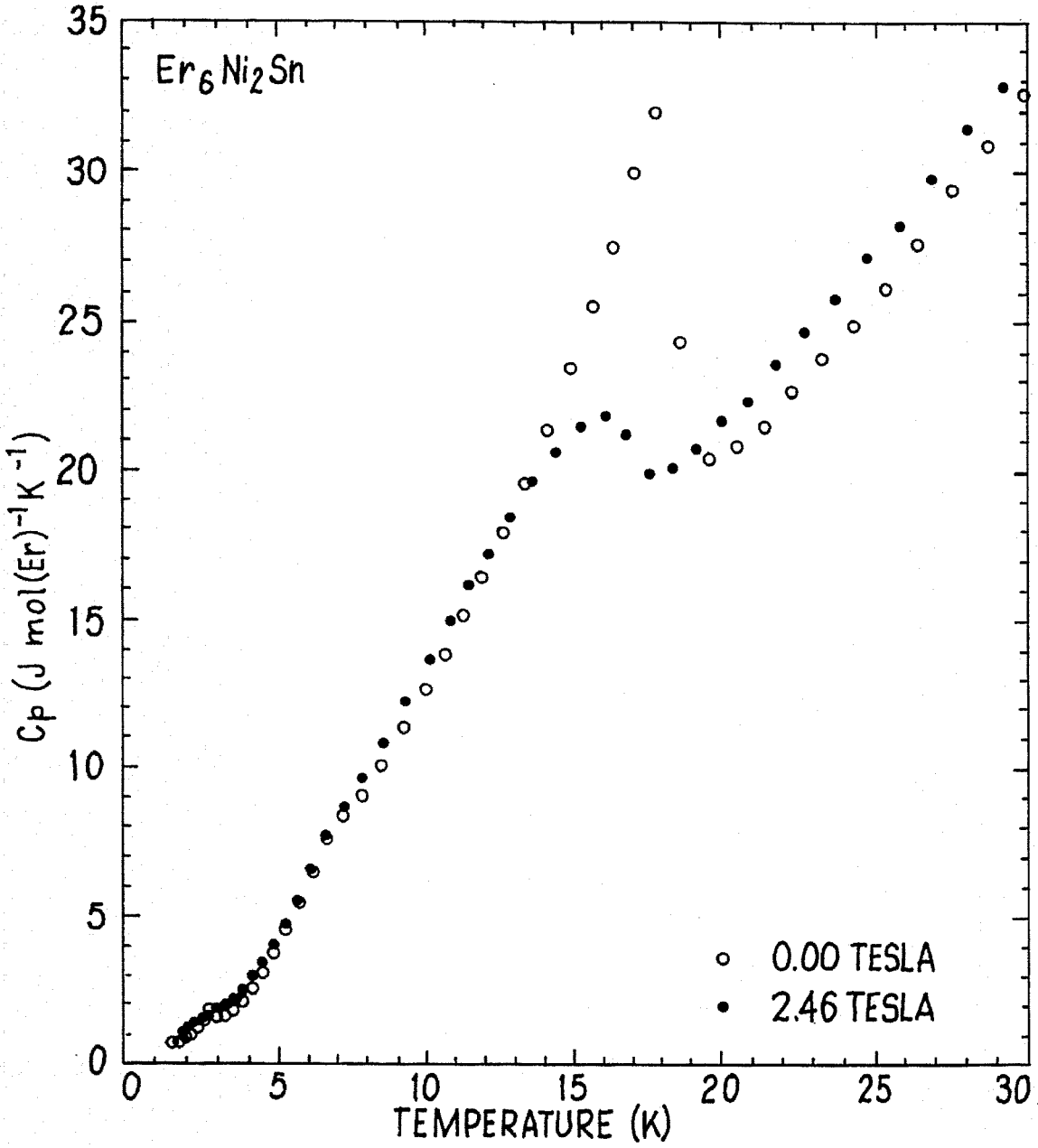
FIG. 13 is a plot of magnetic field heat capacity versus temperatures for $Er_6Ni_2Sn$.

In order to determine the type of magnetic phase transition for $Er_6Ni_2X$ compounds of the invention, the dc susceptibilities of the as-cast $Er_6Ni_2Pb$ (FIG. 11) and $Er_6Ni_2(Sn_{0.75}Ga_{0.25})$ (FIG. 12) samples and the magnetic field heat capacity of annealed $Er_6Ni_2Sn$ (FIG. 13) were measured. Above ~50K, the magnetic susceptibility of the two compounds of FIGS. 11 and 12 obeys the Curie-Weiss law with an effective magnetic moment of 9.73(1) and 9.61(1) $\mu_B$ and a paramagnetic Curie temperature of 5.1(8) and 4.8(3)K, respectively. The effective magnetic moments are close to the theoretical value of 9.58 $\mu_B$ for free $Er^{+3}$ ion. The positive paramagnetic Curie temperatures suggest, that these materials order ferromagnetically. The susceptibility behavior of $Er_6Ni_2Sn$, however, shows a sharp decrease below ordering temperature (~18K), which is typical for antiferromagnets. A magnetic field of 2.46 (FIG. 13) Tesla suppresses the ~17K zero magnetic field heat capacity maximum of $Er_6Ni_2Sn$ both in magnitude and temperature, which is again typical of antiferromagnets. Therefore, the $Er_6Ni_2X$ compounds, where X=Sn, Pb and combination of 0.75Sn+0.25 Ga, are believed to order ferrimagnetically around 17K.

The three ternary ($Er_6Ni_2Sn$, $Er_6Ni_2Pb$ and a 50:50 $Er_6Ni_2Sn/Er_3Ni$) and the quaternary $Er_6Ni_2(Sn_{0.75}Ga_{0.25})$ alloys of the invention are candidate materials for the low temperature stage of GM cryocooler. Heat capacity measurements indicate that the ternary alloys of the invention in both the as-cast and heat treated conditions and the quaternary material of the invention in the heat treated state, would be superior to $Er_3Ni$ and especially Pb for a cryocooler operating to a temperature down to ~10K. The significantly higher heat capacities below 18K indicate that the $Er_6Ni_2X$ materials of the invention would have greater cooling power at ~10K than Pb for the same size cryocooler. Or, for the same amount of cooling power the size of the cryocooler could be reduced.

The $Er_6Ni_2Pb$ alloy appears to be the most preferred heat regenerator material of the invention. The materials of the invention have moderately low melting point (e.g. 934° C. for $Er_6Ni_2Pb$) and should be readily fabricated into spheres to be used in a regenerator bed by a gas atomization or a centrifugal atomization technique. The heat capacities of these spheres are expected to lie somewhere between the as-cast and heat treated results reported here, since the cooling rate during the atomization process is slower than that in arc-melted process which was used to prepare the as-cast materials of the invention. Furthermore, in handling these materials, the ternary materials of the invention seem to be less brittle than $Er_3Ni$ which may be an advantage in handling the cryocooler materials. Furthermore, they also are stable in ambient room temperature conditions.

While the invention has been described in terms of specific embodiments thereof, it is not intended to be limited thereto but rather only to the extent set forth hereafter in the following claims.

The embodiments of the invention in which an exclusive property or privilege is claimed are defined as follows:

1. A Gifford-McMahon cryocooler having a low temperature stage wherein the low temperature stage includes a passive magnetic regenerator selected from at least one material having atomic composition: about $Er_6Ni_2Sn$, about $Er_6Ni_2Pb$, and about $Er_6Ni_2(Sn_{1-x}Ga_x)$ where x is greater than 0 and less than 1.

2. A Gifford-McMahon cryocooler having a low temperature stage wherein the low temperature stage includes a passive magnetic regenerator comprising $Er_9Ni_3Sn$ alloy where there is present a mixture of $Er_3Ni$ phase and $Er_6Ni_2Sn$ phase in the microstructure of the alloy.

3. The cryocooler of claim 2 including a 50:50 meter ratio of $Er_3Ni$ and $Er_6Ni_2Sn$.

4. A passive magnetic regenerator selected from at least one material having atomic composition: about $Er_6Ni_2Pb$ and about $Er_6Ni_2(Sn_{1-x}Ga_x)$ where x is greater than 0 and less than 1, having a volumetric heat capacity greater than that of $Er_3Ni$ between about 8K and about 19K and greater than that of Pb below about 18K.

5. A passive magnetic regenerator comprising a material having atomic composition $Er_9Ni_3Sn$ and having a volumetric heat capacity greater than that of $Er_3Ni$ between about 8K and about 19K and greater than that of Pb below about 18K.

6. An Er-based alloy selected from the group consisting of $Er_6Ni_2Pb$ and $Er_6Ni_2$ $(Sn_{1-x}Ga_x)$ where x is greater than 0 and less than 1.

7. The alloy of claim 6 comprising $Er_6Ni_2$ $(Sn_{0.75}Ga_{0.25})$.

8. A cryocooler having a low temperature stage wherein the low temperature stage includes a passive magnetic regenerator selected from at least one material having atomic composition: about $Er_6Ni_2Sn$, about $Er_6Ni_2Pb$, and about $Er_6Ni_2(Sn_{1-x}Ga_x)$ where x is greater than 0 and less than 1.

9. A cryocooler having a low temperature stage wherein the low temperature stage includes a passive magnetic regenerator comprising $Er_9Ni_3Sn$ alloy where there is present a mixture of $Er_3Ni$ phase and $Er_6Ni_2Sn$ phase in the microstructure of the alloy.

10. A cryocooler having a low temperature stage wherein the low temperature stage includes a passive magnetic regenerator made from an alloy comprising about 66.7 atomic % Er, about 22.2 atomic % Ni, and about 11.1 atomic % of one of Sn, Pb, and $Sn_{1-x}Ga_x$, where x is greater than 0 and less than 1, said alloy having been heat treated and having a volumetric heat capacity greater than that of $Er_3Ni$ between about 8K and about 19K and greater than that of Pb below about 18K.

11. A passive magnetic regenerator made from an as-cast or heat treated alloy comprising about 66.7 atomic % Er, about 22.2 atomic % Ni, and about 11.1 atomic % of one of Pb and $Sn_{1-x}Ga_x$, where x is greater than 0 and less than 1, said alloy having been heat treated and having a volumetric heat capacity greater than that of $Er_3Ni$ between about 8K and about 19K and greater than that of Pb below about 18K.

* * * * *